United States Patent [19]

Hager

[11] Patent Number: 4,878,579

[45] Date of Patent: Nov. 7, 1989

[54] TAMPER-PROOF COIN CASE

[75] Inventor: Alan Hager, Stamford, Conn.

[73] Assignee: Robert M. Paul, Meadowbrook, Pa.

[21] Appl. No.: 42,174

[22] Filed: Apr. 24, 1987

[51] Int. Cl.[4] ..... A45C 11/28

[52] U.S. Cl. ..... 206/0.84; 206/0.83

[58] Field of Search ..... 206/0.80, 0.81, 0.82, 206/0.83, 0.84, 232; 40/10 R, 159, 152

[56] References Cited

U.S. PATENT DOCUMENTS

| | | | |
|---|---|---|---|
| 3,069,001 | 12/1962 | Burdick | 206/0.83 |
| 3,139,977 | 7/1964 | Burdick | 206/0.81 X |
| 3,229,809 | 1/1966 | Spadaro | 206/0.82 |
| 3,241,659 | 3/1966 | Segel | 206/0.82 |
| 3,448,850 | 6/1965 | Segel et al. | 206/0.8 |
| 3,500,995 | 3/1970 | Forman . | |
| 3,611,604 | 10/1971 | Saltzman | 40/10 R X |
| 3,776,643 | 12/1973 | Titoff . | |
| 3,782,537 | 1/1974 | Segel | 206/0.82 |
| 3,788,464 | 1/1974 | Skinner | 206/0.82 |
| 4,165,573 | 8/1979 | Richards | 206/0.8 X |
| 4,592,465 | 6/1986 | Stein | 206/0.8 X |
| 4,602,447 | 7/1986 | Feingold | 40/159 X |

FOREIGN PATENT DOCUMENTS

| | | | |
|---|---|---|---|
| 1511150 | 9/1978 | Fed. Rep. of Germany | 40/323 |

*Primary Examiner*—Joseph Man-Fu Moy

*Attorney, Agent, or Firm*—St. Onge Steward Johnston & Reens

[57] ABSTRACT

A tamper-proof coin case is presented. The coin case comprises a unitary assembly having a first substantially planar member which has a first element of an interlocking means disposed circumferentially thereabout, the first planar member being joined to a second substantially planar member having a second element of the interlocking means whose shape is complementary to the first element and which is disposed circumferentially about the second planar member. The unitary assembly has a first interior retention zone shaped such that a coin can be retained within the first interior retention zone, a second interior retention zone shaped such that at least one photograph of the coin can be retained within the second interior retention zone and a third interior retention zone shaped such that a certificate for the coin can be retained within the third interior retention zone. Each of the planar members has a first transparent portion located to permit observation of each side of a coin retained within the first interior retention zone, the first planar member further comprising a second transparent portion located to permit observation of a first photograph of the coin located within the second interior retention zone and a third transparent portion located to permit observation of a certificate for the coin located within the third interior retention zone. The unitary assembly is formed by ultrasonically welding the first and second planar members together.

15 Claims, 2 Drawing Sheets

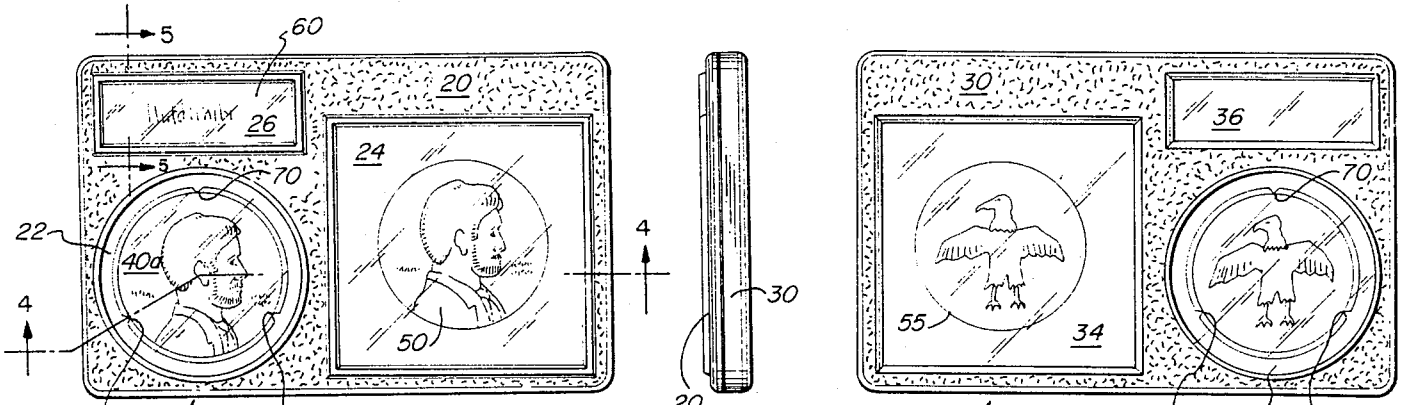
FIG. 1
FIG. 2
FIG. 3
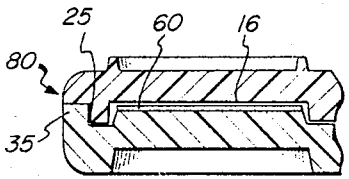
FIG. 5
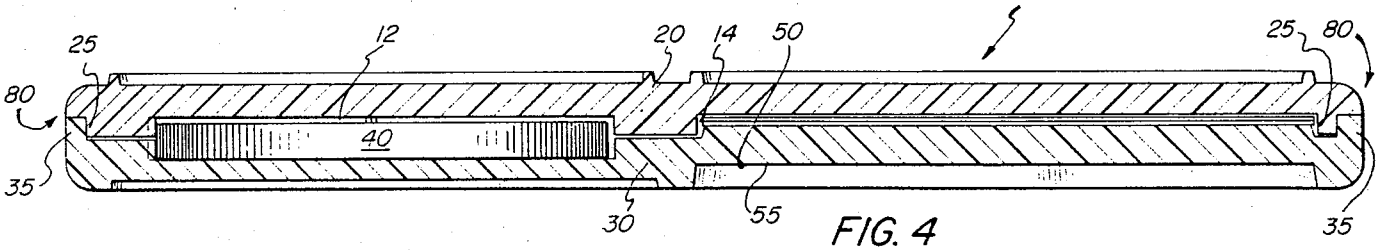
FIG. 4

TAMPER-PROOF COIN CASE

DESCRIPTION

Technical Field

The present invention relates to a coin case for display of a rare, valuable or otherwise desirable coin in a case which will provide evidence of any tampering therewith which might occur. The case further provides display of at least one photograph of the coin and a certificate for the coin.

It is not uncommon for disreputable coin dealers, collectors or traders to substitute a coin of lesser value for a displayed coin by opening the display package and replacing the original coin with an inferior substitute. The unsuspecting purchaser can often be misled into believing the substituted coin is the coin he or she thought was being purchased. Without coin display cases which provide both an indication of tampering and a satisfactory method of determining the authenticity of the coin in the display case, such unscrupulous behavior is difficult to prevent.

Unfortunately, such coin cases which would satisfactorily insure the purchaser of the authenticity of the coin he or she is purchasing have not to this point been available.

Background Art

The prior art has disclosed many different types of devices for holding or displaying coins and like objects, none of which exhibit the desired characteristics. For instance, U.S. Pat. No. 3,500,995 to Forman discloses a numismatic storage device comprising a flexible transparent material having a coin pocket and an index card pocket. The disclosed invention not only does not exhibit any tamper-proofing characteristics but is intended to provide convenient accessibility of both coin and index card.

Skinner, in U.S. Pat. No. 3,788,464, teaches the production of a holder for disk-like objects such as coins which comprises a pair of ultrasonically welded planar surfaces which enclose a member having parallel surfaces and a hole having at least three disk (coin) retaining portions extending thereinto for retaining the disk within the hole.

More recently, Stein disclosed a coin display case in U.S. Pat. No. 4,592,465 which comprises an outer lens welded ultrasonically to an inner lens with a central laminate disposed therebetween. The central laminate has a hole for accepting a coin and is formed of a layer of flexible foamed material sandwiched between two layers of sulfur-free acid neutral paper.

What is desired, therefore, is a coin case which allows display of a rare, valuable or otherwise desirable coin while providing evidence of any tampering which may have occurred and allowing the observer to authenticate the coin through the use of a photograph of the coin and certificate for the coin, which are also enclosed within the sealed case.

Disclosure of Invention

The present invention relates to a tamper-proof coin case. More particularly, the present invention relates to a coin case which provides observation of each side of the coin, means for identifying and authenticating the coin and will provide positive evidence of tampering, if any should occur.

The coin case of this invention is comprised of a unitary assembly comprising a first substantially planar member having one element of an interlocking means disposed circumferentially thereabout, the first planar member being joined to a second substantially planar member having the complementary element of the interlocking means disposed circumferentially thereabout.

The unitary assembly has a first interior retention zone which is shaped such that a coin can be retained within the first interior retention zone, a second interior retention zone which is shaped such that at least one photograph of the coin can be retained within the second interior retention zone and a third interior retention zone which is shaped such that a certificate for the coin can be retained within the third interior retention zone. Each of the planar members has a first transparent portion located to permit observation of each side of a coin retained within the first interior retention zone, the first planar member also having a second transparent portion located to permit observation of a first photograph of the coin retained within the second interior retention zone and a third transparent portion located to permit observation of a certificate for the coin retained within the third interior retention zone.

The unitary assembly is formed by ultrasonically welding the first substantially planar member and the second substantially planar member together.

DETAILED DESCRIPTION OF THE DRAWINGS

The present invention will be better understood and its advantages more apparent in view of the following detailed description, especially when read with reference to the appended drawings, wherein:

FIG. 1 is a top plan view of a coin case according to the present invention;

FIG. 2 is a side plan view of a coin case according to the present invention;

FIG. 3 is a bottom plan view of a coin case according to the present invention;

FIG. 4 is a side view in cross-section along lines 4—4 of a coin case according to the present invention;

FIG. 5 is a partially broken away side view in cross-section along lines 5—5 of a coin case according to the present invention.

DETAILED DESCRIPTION OF THE PREFERRED EMBODIMENT

Figure 6:
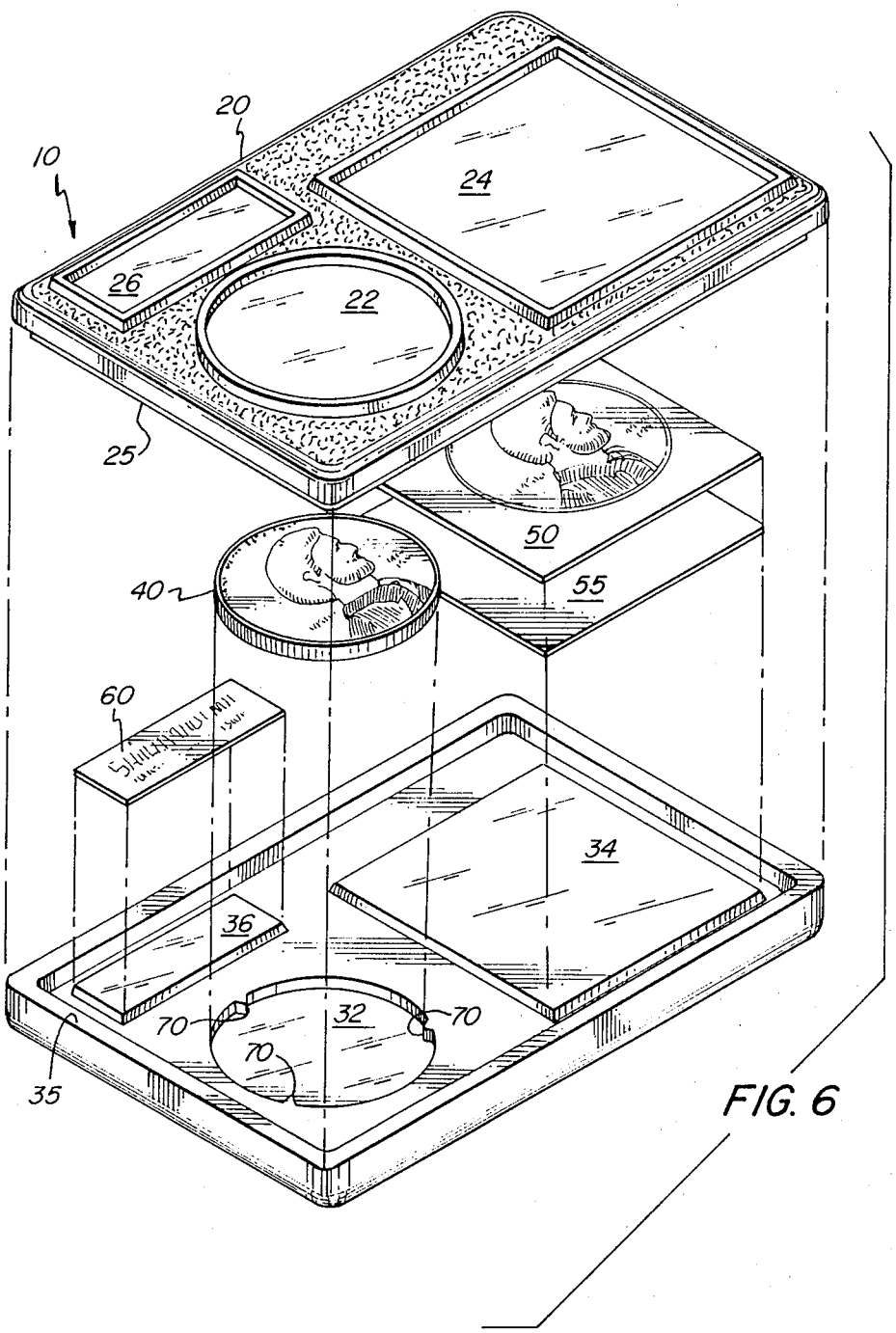
FIG. 6 is an exploded isometric view in perspective of a coin case according to the present invention.

As illustrated in FIGS. 1 and 3, the present invention relates to a tamper-proof coin case which allows the viewing of both sides of a coin retained therein as well as at least one photograph of the coin and a certificate for the coin. The photograph(s) of the coin are used to allow the observer to compare the coin to the photograph in order to ascertain the authenticity of the coin. As used herein, the term 'certificate for the coin' refers to a substrate, such as paper or plastic, having a legend which provides an indicator of coin identity and quality, such as by the "accugrade" system of coin grading. The terms "top", "bottom", "upper", "lower", etc. refer to the tamper-proof coin case of this invention in the orientation illustrated in FIG. 4. It will be understood that the tamper-proof coin case may assume a variety of different orientations when in actual use.

The tamper-proof coin case of this invention generally comprises a unitary assembly 10 which is comprised of a first substantially planar member 20 which makes up the top surface of the coin case, as illustrated in FIG. 4. First planar member 20 is operatively associated with, or permanently joined to, a second substantially planar member 30. First and second substantially planar member 20 and 30 are operatively associated to each other by use of interlocking means 80, which comprises a first element 25 disposed circumferentially about first substantially planar member 20 and a second, complementary element 35 disposed circumferentially about second substantially planar member 30. Elements 25 and 35 are interfitting, by which is meant that one fits within the other when first and second substantially planar members are operatively associated. For the purposes of this invention, it is not critical whether element 25 disposed on first substantially planar member 20 or element 35 disposed on second substantially planar member 30 is the inside element and which is the outside element of interlocking means 80. Advantageously, first and second substantially planar members 20 and 30 are formed of a plastic material, most preferably polystyrene.

Elements 25 and 35 are ultrasonically welded together by conventional means, such as by an ultrasonic welder commercially available from Sonics and Materials, Incorporated of Danbury, Connecticut, to permanently join first and second substantially planar members 20 and 30 and thus form unitary assembly 10. Most preferably, first and second substantially planar members 20 and 30 are ultrasonically welded from above which, it has been found, provides the most complete joining of the two elements, although ultrasonically welding from other directions will be adequate to join first and second substantially planar members 20 and 30 sufficient to provide the advantageous characteristics of the tamper-proof coin case of this invention. Advantageously, a portion of the surface of each of elements 25 and 35 may be reeded, by which is meant that the surface has serrations or corrugations, such as those on the edge of a coin. Most preferably, these reeded portions are present on the portions of elements 25 and 35 which abut each other when interfit. In any case, ultrasonically welding elements 25 and 35 leads to a more complete and permanent joining of first and second substantially planar members 20 and 30. Attempts to separate first and second substantially planar members 20 and 30 lead to a ripping or tearing of the bond, instead of an even peeling apart which would be possible without ultrasonically welding elements 25 and 35. The ripping or tearing which would be seen when attempts are made to separate unitary assembly 10 of this invention provides clear evidence of tampering which would be apparent to even the casual observer.

As illustrated in FIGS. 4 and 5, unitary assembly 10 comprises a first interior retention zone 12, a second interior retention zone 14, and a third interior retention zone 16. The first, second and third interior retention zones 12, 14 and 16 are respectively shaped such that a coin, at least one photograph of the coin and a certificate for the coin can be retained therein.

First interior retention zone 12, in which a coin 40 may be retained, can have any diameter suitable for retention of coin 40 therein. Preferably, the diameter chosen is specific for coin 40 to prevent movement of coin 40 within unitary assembly 10. To accommodate most coins of the types commonly displayed, first interior retention zone 12 should have a diameter of about 15 millimeters to about 42 millimeters. When coin 40 comprises a silver dollar, first interior retention zone should preferably be about 36 millimeters to about 42 millimeters in diameter. Likewise, when coin 40 comprises a 2½ dollar gold piece, the diameter of first interior retention zone should be about 15 millimeters to about 21 millimeters. The diameter of first interior retention zone 12 when coin 40 is another coin, such as a 20 dollar gold piece, a penny, etc. would be easily determinable to the skilled artisan.

Because of variations in diameter which occur from coin to coin, it is difficult to produce first interior retention zone 12 to the exact diameter of coin 40. It is desirable, therefore, for nibs 70 to extend into first interior retention zone 12 to secure coin 40 in position, as illustrated in FIGS. 1 and 3. Nibs 70 are advantageously formed of a deformable material, such as a plastic, to allow coin 40 to be engaged and secured thereby.

As was the case with the diameter of coin 40, first interior retention zone 12 should also be sized to accomodate the thickness of coin 40. Preferably, when coin 40 is a United States coin of the type commonly displayed, the thickness of first interior retention zone is about 2.5 millimeters to about 2.8 millimeters. Of course, the thickness may be varied with the particular coin being displayed in the coin case of the present invention, as would be familiar to the skilled artisan.

Unitary assembly 10 also comprises a second interior retention zone 14, as illustrated in FIG. 4, which is of suitable size and shape to accomodate at least one photograph 50 of coin 40 to provide the observer with a detailed comparison to enable him/her to insure that coin 40 is the correct coin. Although one photograph (of, for instance, an enlargement of the head of the coin) will provide satisfactory results, most preferably two photographs 50 and 55 of coin 40 are present in second interior retention zone 14, to provide the observer with views of both the front and back of coin 40. In this way, the observer can be confident that coin 40 is, in fact, the correct coin by comparing the actual coin with photographs 50 and 55. Second interior retention zone 14 should be sufficiently thin to securely retain photograph(s) 50 (and 55) within second interior retention zone. Advantageously, second interior retention zone 14 is formed by a projection 34 extending upward from second substantially planar member 20, which causes second interior retention zone to be sufficiently thin to retain photographs 50 and 55.

Preferably, unitary assembly 10 further comprises a third interior retention zone 16, as illustrated in FIG. 5, to accomodate a certificate 60 for the coin. Third interior retention zone 16 is preferably formed by a projection 36 extending upward from second substantially planar member 20 and is sufficiently thin to allow certificate 60 to be securely retained in third interior retention. Certificate 60 provides the observer with valuable information about the coin, both in terms of identification and description of quality.

As illustrated in FIGS. 1 and 6, first substantially planar member 20 comprises a first transparent portion 22 which corresponds in location to first interior retention zone 12. First transparent portion 12 allows the observer to view the side **40*a* of coin 40 facing upwards, usually the "head" 40*a* of coin 40. First substantially planar member 20 also comprises a second transparent portion 24 which corresponds in location to second interior retention zone 14. Second transparent portion 24 allows the observer to view a first photograph 50 of coin 40. First photograph 50 of coin 40 preferably comprises a photograph of side 40*a* of coin 40 which can be viewed through first transparent portion 22. In this way, the observer can easily compare coin 40 with photograph 50 to determine the authenticity of coin 40. First substantially planar member 20 further comprises a third transparent portion 26, corresponding in location to third interior retention zone 16. Third transparent portion 26 permits the observer to view certificate 60, which provides identification and quality information about coin 40. Advantageously, the areas of the surface of first substantially planar member 20 which do not comprise first, second or third transparent portions, 22, 24 or 26, have a surface matte or texture which render them at least partially opaque, to enable the observers attention to be directed to first, second and third transparent portions 22, 24 and 26**.

As illustrated in FIGS. 3 and 6, second substantially planar member 30 comprises a first transparent portion 32 which corresponds in location to first interior retention zone 12. First transparent portion 32 permits the observer to view the side **40*b* of coin 40 which faces downwards, usually the "tail" of coin 40. In a preferred embodiment, second substantially planar member 30 further comprises a second transparent portion 34 which corresponds in location to second interior retention zone 14. When a second photograph 55 of coin 40 is present in second interior retention zone 14, second transparent portion 34 permits the observer to view it. Typically, second photograph 55 is a photograph of the side of coin 40 opposite that which appears in first photograph 50. Generally, second photograph 55, when present, will be of side 40*b* of coin 40, i.e., the side of coin 40 facing downwards, for convenient comparison with coin 40 to authenticate coin 40. As was the case with first planar member 20, the areas of the surface of second planar member 30 which do not comprise transparent portions 32 or 34, advantageously have a surface matte or texture which render them at least partially opaque, to enable the attention of the observer to be directed to transparent portions 32 and 34**.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

I claim:

1. A tamper-proof coin case which is comprised of a unitary assembly comprising a first substantially planar member having a first element of an interlocking means disposed circumferentially thereabout, said first planar member being joined to a second substantially planar member having a second element of said interlocking means whose shape is complementary to said first element and which is disposed circumferentially about said second planar member, said unitary assembly having a first interior retention zone shaped such that a coin can be retained within said first interior retention zone, a second interior retention zone shaped such that at least one photograph of the coin can be retained within said second interior retention zone and a third interior retention zone shaped such that a certificate for the coin can be retained within said third interior retention zone, each of said planar members having a first transparent portion located to permit observation of each side of a coin retained within said first interior retention zone, each of said planar members further comprising a second transparent portion located to permit observation of two photographs of the coin retained within said second interior retention zone and said first planar member further comprising a third transparent portion located to permit observation of a certificate for the coin retained within said third interior retention zone; wherein the exterior surfaces of said first and second planar members which do not comprise said transparent portions have a surface texture which causes at least partial opacity; and further wherein said unitary assembly is formed by ultrasonically welding said first and second planar members together.

2. The tamper-proof coin case of claim 1 wherein said first and second elements of said interlocking means are respectively disposed on said first and second planar members such that one fits inside the other.

3. The tamper-proof coin case of claim 1 which further comprises nibs which extend into said first interior retention zone of said unitary assembly to secure the coin in position.

4. The tamper-proof coin case of claim 1 wherein said first interior retention zone of said unitary assembly is about 15 millimeters to about 42 millimeters in diameter.

5. The tamper-proof coin case of claim 4 wherein said first interior retention zone of said unitary assembly is about 2.5 millimeters to about 2.8 millimeters thick.

6. The tamper-proof coin case of claim 1 which is formed of a plastic.

7. The tamper-proof coin case of claim 6 which is formed of polystyrene.

8. A tamper-proof coin case which is comprised of a unitary assembly comprising a first substantially planar member having a first element of an interlocking means disposed circumferentially thereabout, said first planar member being joined to a second substantially planar member having a second element of said interlocking means whose shape is complementary to said first element and which is disposed circumferentially about said second planar member, said first and second elements of said interlocking means being respectively disposed on said first and second planar members such that one fits within the other, said unitary assembly having a first interior retention zone shaped such that a coin can be retained within said first interior retention zone, a second interior retention zone shaped such that at least one photograph of the coin can be retained within said second interior retention zone and a third interior retention zone shaped such that a certificate for the coin can be retained within said third interior retention zone, each of said planar members having a first transparent portion located to permit observation of each side of a coin retained within said first interior retention zone and a second transparent portion located to permit observation of a first and second photograph of the coin retained within said second interior retention zone, said first planar member further comprising a third transparent portion located to permit observation of a certificate for the coin located within said third interior retention zone; wherein exterior surfaces of said first and second planar members which do not comprise said transparent portions have a surface texture which causes at least partial opacity; and further wherein said unitary assembly is formed by ultrasonically welding said first and second planar members together.

9. The tamper-proof coin case of claim 8 which further comprises nibs which extend into said first interior retention zone of said unitary assembly to secure the coin in position.

10. The tamper-proof coin case of claim 8 wherein said first interior retention zone of said unitary assembly is about 15 millimeters to about 42 millimeters in diameter.

11. The tamper-proof coin case of claim 10 wherein said first interior retention zone of said unitary assembly is about 2.5 millimeters to about 2.8 millimeters thick.

12. The tamper-proof coin case of claim 8 which is formed of a plastic.

13. The tamper-proof coin case of claim 12 which is formed of polystyrene.

14. A tamper-proof coin case which is comprised of a unitary assembly comprising a first substantially planar member having a first element of an interlocking means disposed circumferentially thereabout, said first planar member being joined to a second substantially planar member having a second element of said interlocking means whose shape is complementary to said first element and which is disposed circumferentially about said second planar member, said first and second elements of said interlocking means being respectively disposed on said first and second planar members such that one fits within the other, said unitary assembly having a first interior retention zone shaped such that a coin can be retained within said first interior retention zone, a second interior retention zone shaped such that at least one photograph of the coin can be retained within said second interior retention zone and a third interior retention zone shaped such that a certificate for the coin can be retained within said third interior retention zone wherein said first interior retention zone has a diameter of about 15 millimeters to about 42 millimeters and a thickness of about 2.5 millimeters to about 2.8 millimeters, each of said planar members having a first transparent portion located to permit observation of each side of a coin retained within said first interior retention zone and a second transparent portion located to permit observation of a first and second photograph of the coin located within said second interior retention zone, said first planar member further comprising a third transparent portion located to permit observation of a certificate for the coin located within said third interior retention zone, the exterior surfaces of said first and second planar members which do not comprise said transparent portions having a surface texture which causes at least partial opacity; wherein said unitary assembly is plastic and formed by ultrasonically welding said first and second planar members.

15. The tamper-proof coin case of claim 14 wherein said plastic is polystyrene.

* * * * *